US007716775B2

(12) United States Patent
DiPietro et al.

(10) Patent No.: US 7,716,775 B2
(45) Date of Patent: May 18, 2010

(54) BRUSH

(75) Inventors: Dean DiPietro, Brooklyn, NY (US); Paul Katz, New York, NY (US); Goeran Jerstroem, Brooklyn, NY (US); Forrest Keith Luu, Los Angeles, CA (US); John Thomas Jacobsen, Laguna Niguel, CA (US)

(73) Assignee: Helen of Troy Limited, St. Michael (BB)

( * ) Notice: Subject to any disclaimer, the term of this patent is extended or adjusted under 35 U.S.C. 154(b) by 988 days.

(21) Appl. No.: 11/232,052

(22) Filed: Sep. 21, 2005

(65) Prior Publication Data

US 2007/0143945 A1 Jun. 28, 2007

(51) Int. Cl.
*A46B 5/02* (2006.01)

(52) U.S. Cl. ..... 15/159.1; 15/114; 15/244

(58) Field of Classification Search ..... 15/159.1, 15/188, 117, 110, 228, 229.2, 245.1, 245, 15/244, 106; D4/135
See application file for complete search history.

(56) References Cited

U.S. PATENT DOCUMENTS

| | | | | |
|---|---|---|---|---|
| 1,142,698 | A | 6/1915 | Grove et al. | |
| 2,230,126 | A * | 1/1941 | Westervelt | 401/286 |
| 2,738,529 | A * | 3/1956 | Bernet | 15/115 |
| 2,845,644 | A * | 8/1958 | Wisner | 15/114 |
| 2,935,754 | A * | 5/1960 | Abdo et al. | 401/22 |
| 3,079,628 | A * | 3/1963 | Wright | 401/204 |
| 3,199,139 | A * | 8/1965 | Vallis | 401/22 |
| 3,353,203 | A * | 11/1967 | Ginter | 15/244.1 |
| 3,619,845 | A * | 11/1971 | Partridge et al. | 15/117 |
| 5,628,082 | A | 5/1997 | Moskovich | |
| 5,752,287 | A * | 5/1998 | Wheat | 15/176.2 |
| D400,358 | S | 11/1998 | Zemel | |
| 6,041,467 | A | 3/2000 | Roberts et al. | |
| 6,067,684 | A | 5/2000 | Kweon | |
| 6,148,467 | A * | 11/2000 | Martinsson | 15/172 |
| 6,276,021 | B1 * | 8/2001 | Hohlbein | 15/167.1 |
| 6,321,408 | B1 | 11/2001 | Esterson et al. | |
| D455,559 | S | 4/2002 | Wang et al. | |
| D456,615 | S | 5/2002 | Zemel | |
| 6,408,474 | B1 | 6/2002 | Husted et al. | |
| 6,473,929 | B1 * | 11/2002 | Learned, III | 15/146 |
| 6,571,417 | B1 | 6/2003 | Gavney, Jr. et al. | |
| 6,575,651 | B1 | 6/2003 | Bertothy | |
| 6,865,767 | B1 | 3/2005 | Gavney, Jr. | |
| 6,910,241 | B2 | 6/2005 | Wang | |
| 7,059,006 | B1 | 6/2006 | Huff et al. | |
| 7,472,447 | B2 * | 1/2009 | Lougheed | 15/144.1 |
| 2004/0255427 | A1 | 12/2004 | Gavney, Jr. | |
| 2005/0015901 | A1 | 1/2005 | Gavney, Jr. | |
| 2005/0117962 | A1 | 6/2005 | Lion et al. | |
| 2005/0132898 | A1 | 6/2005 | Kahler | |

FOREIGN PATENT DOCUMENTS

| | | |
|---|---|---|
| DE | 20313797 | 11/2003 |

OTHER PUBLICATIONS

EPO Supplemental Search Report, dated Nov. 6, 2009.

* cited by examiner

*Primary Examiner*—Lee D Wilson
(74) *Attorney, Agent, or Firm*—Seyfarth Shaw LLP

(57) ABSTRACT

A brush includes a handle and a head having an array of bristles and a paddle with a plurality of apertures formed therein. The paddle and bristles may be formed of silicone.

28 Claims, 3 Drawing Sheets

BRUSH

BACKGROUND

This application relates to utility brushes, such as household brushes, and it has particular application to kitchen brushes, such as pastry brushes, basting brushes and the like.

Many previous brushes have had a uniform bristle construction which, while working well in certain applications, may have been either too stiff or too soft for other applications, thereby limiting the overall utility of the brush.

Also, prior brushes typically have fibrous bristles, which tend to come loose and may easily become bent or creased.

Further, prior brushes which have been designed for use in basting or other operations for applying liquid to a surface have been limited in their capacity for holding liquid in a relatively dripless manner.

While many such brushes have heretofore been provided, any such brushes have either lacked a good ergonomic design or have been characterized by relatively complicated and/or expensive construction.

SUMMARY

There is disclosed in this application an improved brush construction which has good ergonomic design so as to be relatively easy to grip and to manipulate, particularly for persons with impaired gripping ability, such as those suffering from arthritis or the like. Also, the disclosed brush has a unique molded plastic construction which is relatively economical.

There is also disclosed a brush construction which includes a compound bristle arrangement for improved functioning in liquid-applying applications, such as basting. In particular, there is provided a brush construction which includes a relatively hard paddle portion and a relatively soft bristle portion.

There is also disclosed a brush with non-fibrous bristles.

In an embodiment, a brush comprises a handle portion and a head portion connected to the handle portion, the head portion including an array of bristles and a paddle having a plurality of apertures formed therein.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
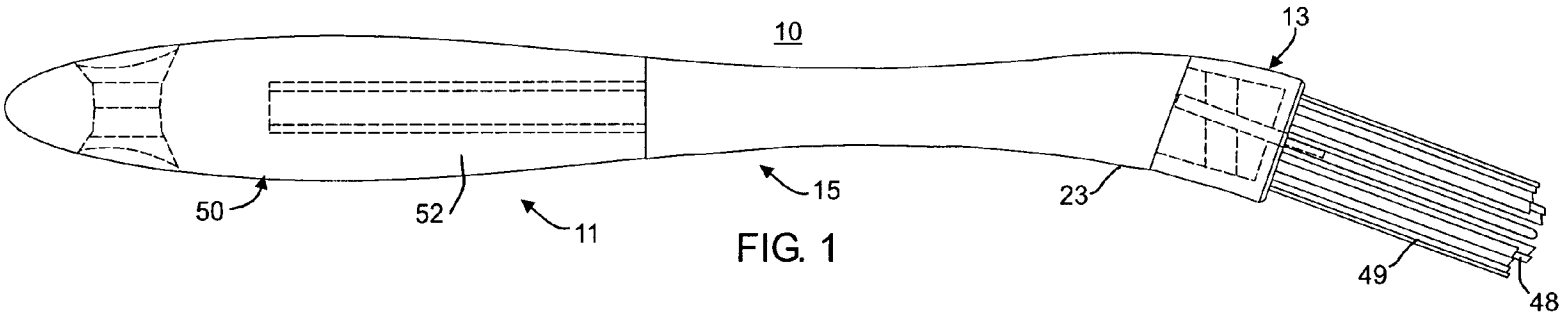
FIG. 1 is a side elevational view of an embodiment of a brush.
Figure 2:
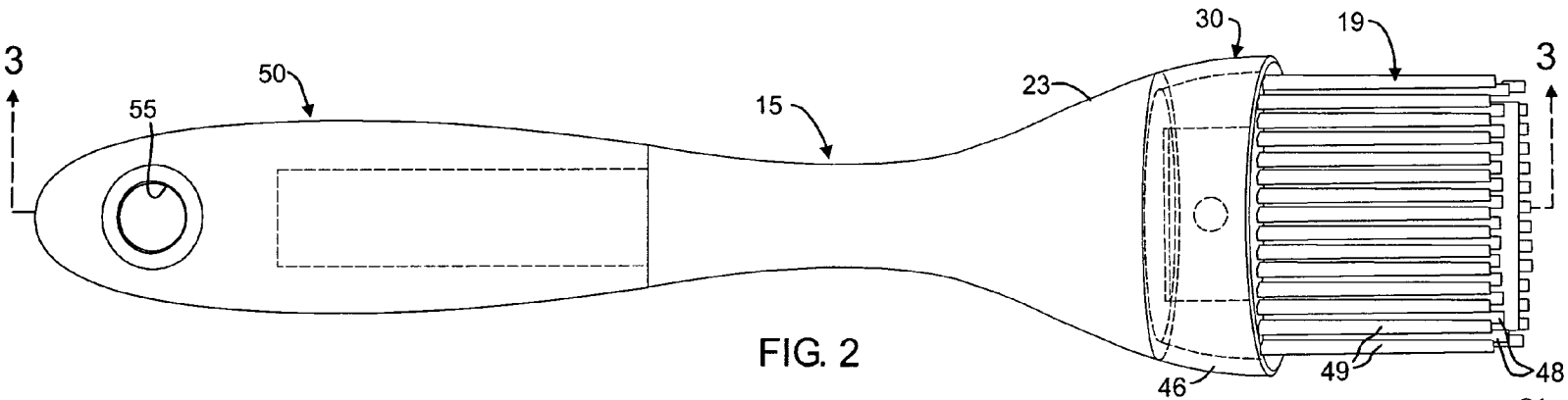
FIG. 2 is a bottom plan view of the brush of FIG. 1.
Figure 3:
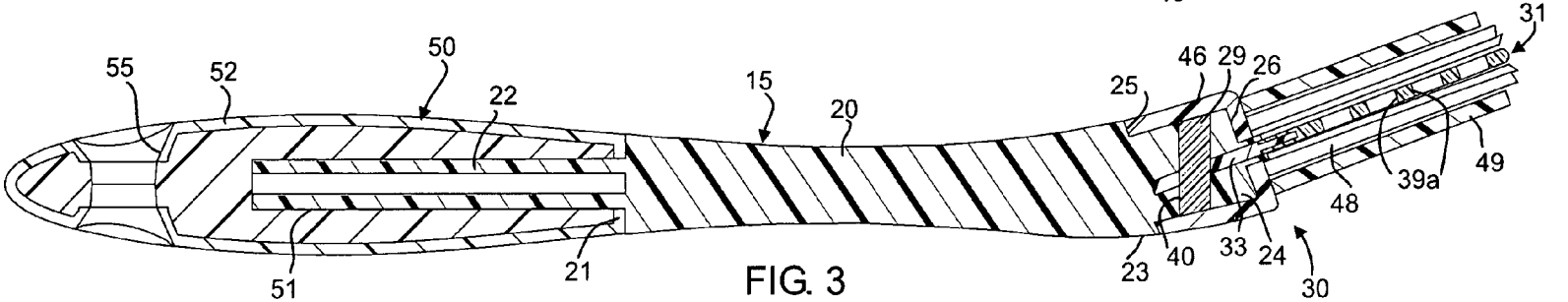
FIG. 3 is a sectional view taken generally along the line 3-3 in FIG. 2.
Figure 7:
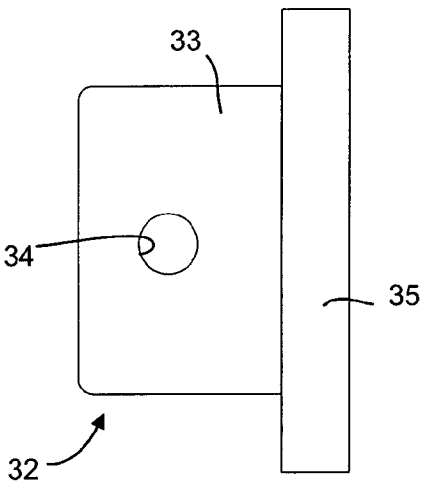
FIG. 7 is a top plan view of the core of FIG. 7.
Figure 6:
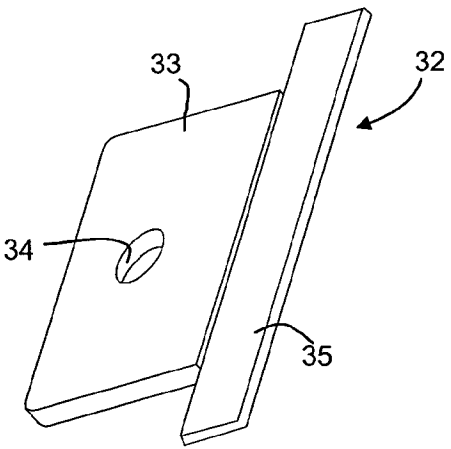
FIG. 6 is an enlarged, perspective view of the paddle core of the brush of FIG. 3.
Figure 4:
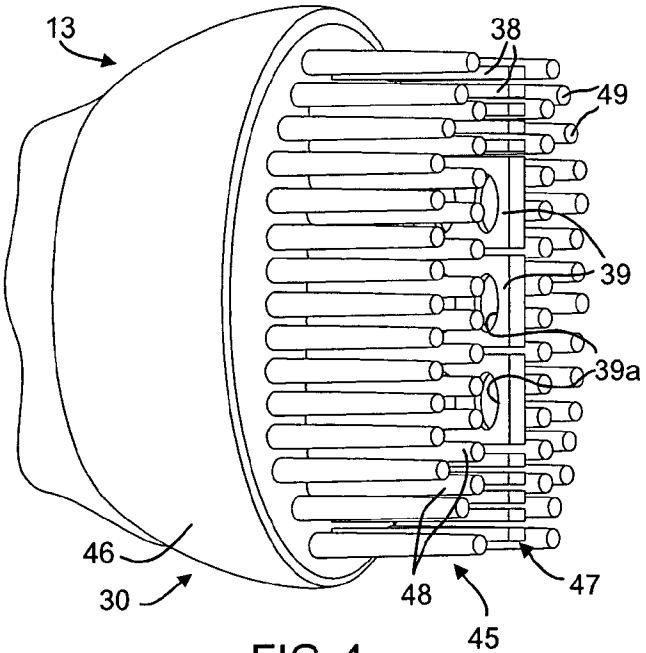
FIG. 4 is an enlarged, fragmentary, front perspective view of the brush of FIG. 1.
Figure 5:
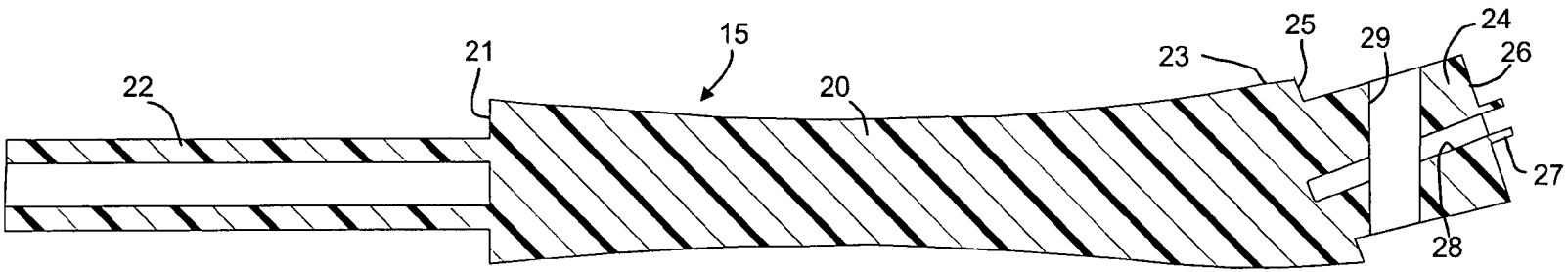
FIG. 5 is an enlarged, sectional view of the body of the brush of FIG. 3.
Figure 8:
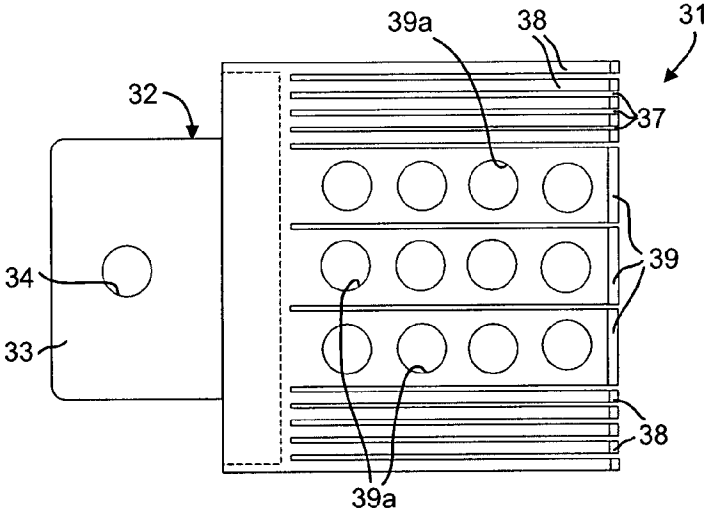
FIG. 8 is an enlarged, top plan view of the paddle assembly of the brush of FIG. 3.

Referring to FIGS. 1-3, there is illustrated a brush, generally designated by the numeral 10 having a handle portion 11 at one end and a head portion 13 at an opposite end of a central body 15. Referring also to FIG. 5, the body 15 has a relatively narrow central neck 20, which flares outwardly toward the rear, terminating a rear end face 21. Projecting rearwardly from the end face 21 is an elongated, hollow, tubular extension 22, which may be oval or rectangular in transverse cross section. The body 15 flares outwardly toward its front end to a widened head end 23, which may be oval in transverse cross section. Projecting forwardly from the head end 23, centrally thereof, is a reduced portion 24, which may also be generally oval in transverse cross section and cooperates with the head end 23 to define therebetween a peripheral shoulder 25. The reduced portion 24 terminates at an end face 26, which has projecting forwardly therefrom, centrally thereof, a short rectangular projection 27. Formed in the projection 27 and extending into and through the reduced portion 24, substantially centrally thereof, is a rectangular slot 28. Extending transversely through the reduced portion 24 and intersecting the slot 28 is a circular hole 29.

Referring also to FIGS. 4 and 6-8, a head assembly 30 is disposed at the head end 23 of the body 15 and cooperates therewith to define the head portion 13. The head assembly 30 includes a paddle assembly 31 (see FIG. 8), which includes a relatively rigid central core 32, which may be formed of a suitable plastic material, such as nylon, and includes a relatively short rectangular portion 33 having a circular hole 34 formed therethrough and integral along one side with a relatively long, narrow rectangular portion 35 which may be of reduced thickness. The core 32 may be molded as a one-piece construction. Compression molded over the long rectangular portion 35 is an outer body 36, which may be relatively flexible as compared to the core 32, and may be formed of a suitable plastic material, such as silicone. The outer body 36 extends well beyond the long rectangular portion 35 of the core 32 in a direction opposite the short rectangular portion 33 and is generally rectangular in shape. A plurality of slots 37 extend longitudinally into the outer body 36 from the distal end thereof, dividing the outer body 36 into two end groups of relatively narrow fingers 38 and a central group of relatively wide fingers 39. In the illustrated embodiment, there are three wide fingers and two groups of five end fingers, with each wide finger having four holes 39a therethrough, but it will be appreciated that the number of fingers and/or holes may vary.

Figure 9:
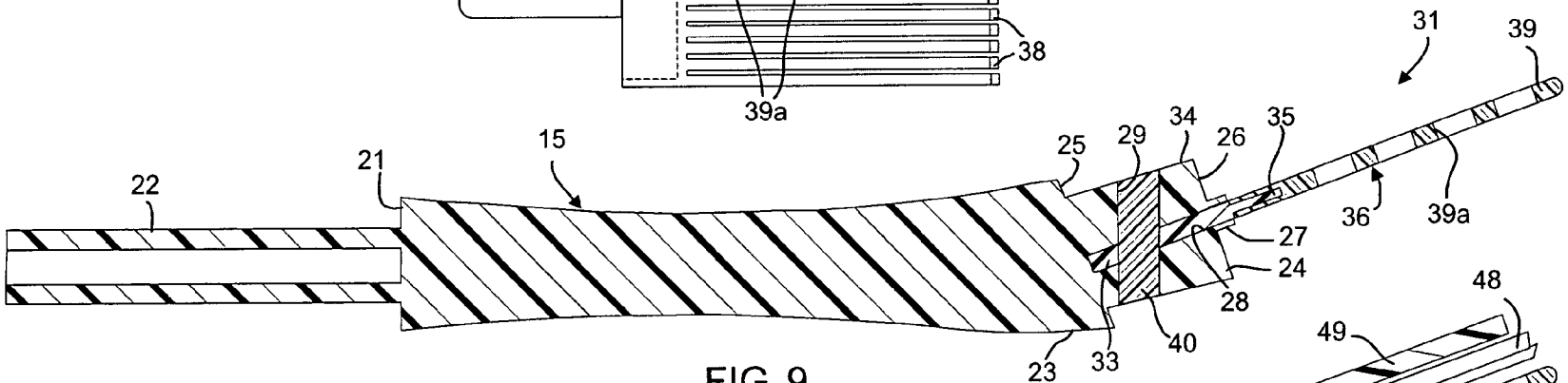
FIG. 9 is a view similar to FIG. 5 of the brush body and paddle assembly.
Figure 10:
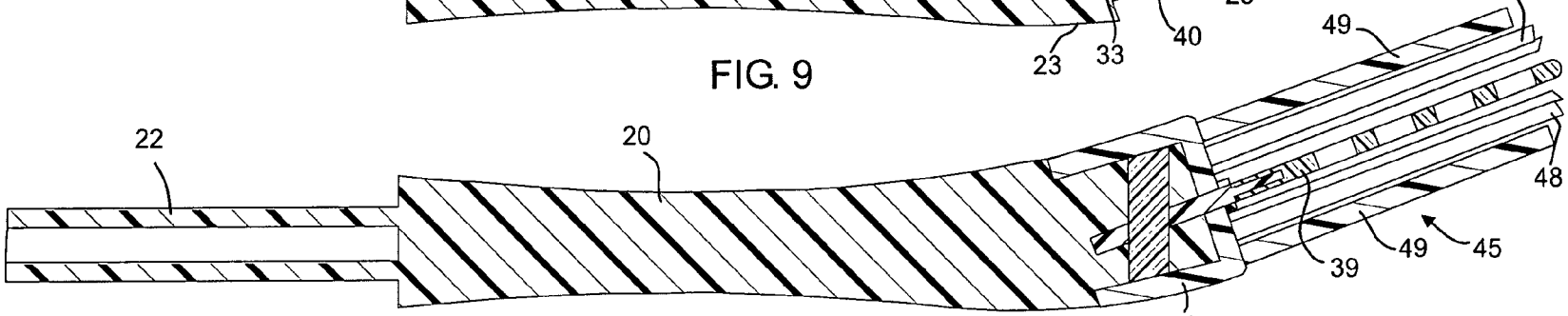
FIG. 10 is a view similar to FIG. 9 of the brush body and head assembly of the brush of FIG. 3.

In assembly, referring to FIG. 9, the short rectangular portion 33 of the core 32 is inserted in the slot 28 in the body 15 until the long rectangular portion 35 and outer body 36 abut the projection 27. When thus inserted, the hole 34 in the core 32 will align with the hole 29 in the body reduced portion 24. A pin 40, which may be formed of a suitable plastic material, such as nylon, is inserted through these aligned holes to retain the paddle assembly 31 in place on the body 15.

The head assembly 30 also includes a bristle assembly 45, which includes a generally cup-shaped peripheral collar 46 which surrounds the reduced portion 24 of the body 15 and abuts the shoulder 25. Projecting forwardly from the collar 46 is an array of non-fibrous bristles which includes a plurality of relatively long inner bristles 48 arranged on opposite sides of the paddle assembly 31, and a plurality of shorter outer bristles 49 arranged just outside the inner bristles 48, as can best be seen in FIGS. 1-4 and 10.

The bristle assembly 45 may be formed by injection molding onto the head end 23 of the body 15 and may be formed of a suitable, relatively soft plastic material, such as silicone. More specifically, the bristle assembly 45 may be molded as a one-piece unit. While both the outer body 36 of the paddle assembly 31 and the bristle assembly 45 may be formed of silicone, the former is preferably a relatively high durometer material, while the latter is preferably a relatively low durometer material.

Referring to FIGS. 1-3, the handle portion 11 includes a handle grip 50, which may be mounted on the tubular extension 22 of the body 15. In the illustrated embodiment, the grip 50 has a relatively rigid inner core 51 which may be formed of a suitable plastic, such as polypropylene, and is overmolded with an outer body 52 of flexible and resilient material which affords improved frictional gripping, such as a material of the type sold under the trademark SANTOPRENE. In assembly, the grip 50 may be press-fitted or snap-fitted onto the tubular extension 22 of the body 15, or may be secured in place, as by suitable adhesives. Alternatively, if desired, the grip 50 may be molded onto the tubular extension 22. Preferably, the grip 50 has a hole 55 formed therethrough adjacent to the distal end thereof to facilitate hanging of the brush 10. The grip 50 has a relatively enlarged configuration, which may be substantially oval in transverse cross section and is designed to facilitate comfortable gripping by a user's hand.

The head end 23 of the body 15 may be inclined with respect to the remainder of the body 15 and the handle portion 11, as can best be seen in FIGS. 1 and 3, to facilitate access to surfaces to which the brush is to be applied.

In use, the holes 39a in the paddle assembly 31 increase surface area to facilitate retention of liquid materials to be applied by the brush 10 to associated surfaces. This feature may, for example, have particular application in basting operations or the like. The fingered construction of the paddle assembly 31 facilitates flexing thereof to assist in allowing the paddle assembly to follow the contours of the surface to which the brush is being applied. If desired, the bristle assembly 45 may be slightly more flexible than the paddle assembly 31 and, if desired, the inner bristles 48 and the outer bristles 49 may have different degrees of flexibility or stiffness.

From the foregoing, it can be seen that there is provided an improved brush which is of simple and economical construction, which is ergonomically designed, which facilitates the retention of liquids and facilitates access to surfaces upon which the brush is to be used.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A kitchen brush assembly comprising:

a handle for gripping the kitchen brush;

a head extending from the handle in a first direction;

a liquid applying portion extending from the head in the first direction, the liquid applying portion including:

a plurality of bristles, and a paddle including a plurality of paddle portions arranged in a second direction lateral and transverse to the first direction, the paddle portions defined by slots therebetween arranged in the second direction, the slots opening at one end and defining a gap between the paddle portions for retention of liquid during use, the paddle portions having a width in the second direction substantially larger than a thickness, wherein at least two of the paddle portions includes circular apertures formed therein for retention of liquid during use, the liquid applying portion further having a flange and having a tongue extending from the flange, the tongue received within the head for securement therewith, the paddle portions extending from the flange, and the tongue having a dimension in the second direction less than a dimension of the flange in the second direction.

2. The kitchen brush assembly of claim 1 wherein the bristles have a first dimension in the second direction transverse to the first direction, and the width of paddle portions extends in the second direction, and the width is greater than the first dimension of the bristles.

3. The kitchen brush assembly of claim 1 wherein the plurality of bristles includes a set of bristles peripherally located relative to the paddle, the first set of bristles including a peripheral collar for securement with the head.

4. The kitchen brush assembly of claim 3 wherein the first set of bristles is formed integral with the collar.

5. The kitchen brush assembly of claim 3 wherein the head includes a widened portion, and the collar is formed of a soft plastic material for securing the collar with the widened portion.

6. The kitchen brush assembly of claim 5 wherein the head and widened portion define a shoulder, and the collar is secured against the shoulder.

7. The kitchen brush assembly of claim 1 wherein the paddle includes a base for securement with the head, the head including at least one bore securing the paddle in the head.

8. The kitchen brush assembly of claim 7 wherein the plurality of bristles includes a second set of bristles, and the second set of bristles is formed integral with the paddle base and paddle portions.

9. The kitchen brush assembly of claim 1 wherein the paddle portions are centrally disposed with respect to the head.

10. The kitchen brush assembly of claim 1 wherein the paddle portions include at least three paddle portions each having a plurality of apertures formed therein and each paddle portion being separated by a slot extending from a distal end of the paddle portion substantially to a base, and the paddle further includes a set of bristles.

11. The kitchen brush assembly of claim 10 wherein the paddle base has a first hardness, the paddle portions have a second hardness, and the paddle bristles have a third hardness.

12. The kitchen brush assembly of claim 11 wherein at least two of the hardnesses are different.

13. The kitchen brush assembly of claim 1 wherein the head is angled from the handle.

14. The kitchen brush assembly of claim 10 wherein the handle includes a flexible and resilient gripping portion.

15. A kitchen brush assembly comprising:

a handle for gripping the kitchen brush;

a head extending from the handle in a first direction;

a liquid applying portion extending from the head in the first direction, the liquid applying portion including:

a paddle having at least two paddle portions separated by respective longiitudinal slots open at one end of the paddle, said slots defining a gap between the paddle portions for retention of liquid during use, and a plurality of apertures formed between the slots for retention of liquid during use, and a bristle assembly including a collar and a set of bristles extending from and integral with the collar, the bristles located on both sides of the paddle, wherein the head includes a widened portion, and the collar is composed of a soft plastic material whereby the collar is secured on the widened portion.

16. The kitchen brush assembly of claim 15 wherein the set of bristles is formed integral with the collar.

17. The kitchen brush assembly of claim 15 wherein the head and widened portion define a shoulder, and the collar is secured against the shoulder.

18. The kitchen brush assembly of claim 15 wherein the paddle includes a plurality of paddle portions arranged in a second direction transverse to the first direction and defined by slots therebetween, the paddle portions being widened in the a second direction transverse to the first direction, and the apertures extend through the paddle portions in a third direction transverse to the first and second directions.

19. The kitchen brush assembly of claim 18 wherein each bristle of the set of bristles has a first dimension in the second direction, the paddle portions have a second dimension in the second direction, and the second dimension is greater than the first dimension.

20. The kitchen brush assembly of claim 15 wherein the head is angled from the handle.

21. The kitchen brush assembly of claim 15 wherein the handle includes a flexible and resilient gripping portion.

22. A kitchen brush assembly comprising:

a handle for gripping the kitchen brush;

a head extending from the handle in a first direction;

a liquid applying portion extending from the head in the first direction, the liquid applying portion including:

a plurality of bristles, and a paddle including a plurality of paddle portions arranged in a lateral direction orthogonal to the first direction and defined by slots therebetween open at one end of the paddle, said slots defining a gap between the paddle portions for retention of liquid during use, the paddle portions having a width in the lateral direction, the width being substantially larger than a thickness, at least two of the paddle portions including apertures formed therein and between the longitudinal slots, the slots and apertures retaining liquid during use.

23. The kitchen brush assembly of claim 22 wherein the slots extend substantially along the length of the paddle in the first direction to a base portion of the paddle.

24. The kitchen brush assembly of claim 22 wherein the slots extend longitudinally into the paddle from a distal end thereof.

25. The kitchen brush assembly of claim 22 wherein the slots and apertures are formed in the paddle in the a second direction generally orthogonal to the first direction.

26. The kitchen brush assembly of claim 22 wherein the plurality of bristles includes a set of bristles peripherally located relative to the paddle, the first set of bristles including a peripheral collar formed integral with the bristles for securement with the head, and wherein the head includes a widened portion forming a shoulder, and the collar is formed of a soft plastic material for securing the collar with the widened portion against the shoulder.

27. The kitchen brush assembly of claim 22 wherein the paddle portions include at least three paddle portions each having a plurality of apertures formed therein and each paddle portion being separated by a slot extending from a distal end of the paddle portion substantially to the base, and the paddle further includes a set of bristles.

28. The kitchen brush assembly of claim 22 wherein the paddle base has a first hardness, the paddle portions have a second hardness, and the paddle bristles have a third hardness, and at least two of the hardnesses are different.

* * * * *